United States Patent [19]

Welch et al.

[11] 4,446,915

[45] May 8, 1984

[54] HEAT EXCHANGER TUBE CIRCUITS

[75] Inventors: Donald C. Welch; Christopher P. Yoerg, both of La Crosse, Wis.

[73] Assignee: The Trane Company, La Crosse, Wis.

[21] Appl. No.: 368,349

[22] Filed: Apr. 14, 1982

[51] Int. Cl.[3] ..... F28D 7/08; F28F 1/32

[52] U.S. Cl. ..... 165/144; 165/150; 165/151; 165/176

[58] Field of Search ..... 165/150, 151, 176, 172, 165/140, 144, 145

[56] References Cited

U.S. PATENT DOCUMENTS

| | | | |
|---|---|---|---|
| 2,054,404 | 9/1936 | Askin | 165/151 |
| 2,657,020 | 10/1953 | Hofmeister | 165/172 |
| 2,667,762 | 2/1954 | Hornaday | 165/140 |
| 3,346,043 | 10/1967 | Thurnauer | 165/172 X |
| 3,675,710 | 7/1972 | Ristow | 165/176 X |

FOREIGN PATENT DOCUMENTS

| | | | |
|---|---|---|---|
| 31330 | 4/1961 | Finland | 165/176 |

*Primary Examiner*—Sheldon J. Richter

*Attorney, Agent, or Firm*—Carl M. Lewis; Ronald M. Anderson; Raymond W. Campbell

[57] ABSTRACT

Tube circuits for heat exchangers which provide same-end inlet and outlet connections are disclosed, in which each circuit includes conduits of two types. In a preferred embodiment, the first type conduit has two tubes and is generally U-shaped, and the second type conduit has four tubes. The inlets for each conduit are disposed adjacent each other in the assembled heat exchanger, as are the outlets for the conduits. To equalize flow and pressure drop a turbulence promoting device can be disposed in the U-shaped conduit. The circuits can be used for providing same-end connections on coils previously available only in opposite end connection configurations, such as for example, three-row full-circuited and six-row double circuited coils.

20 Claims, 15 Drawing Figures

FIG. 11
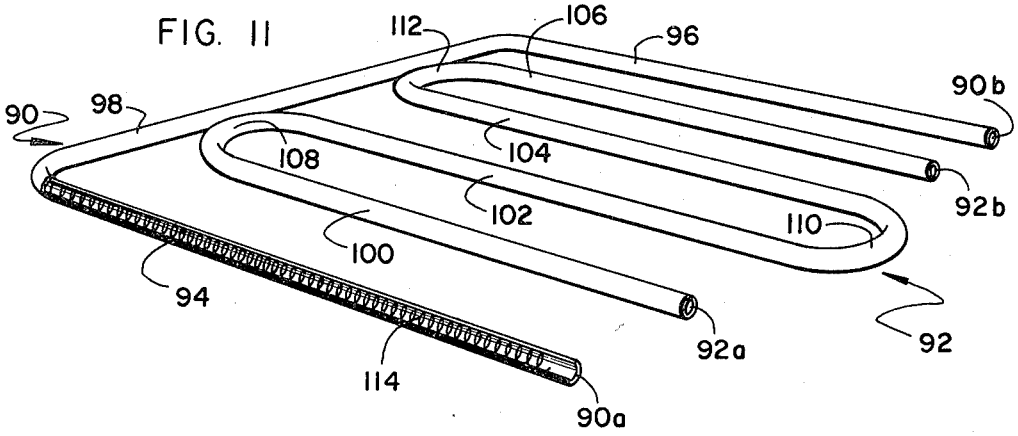
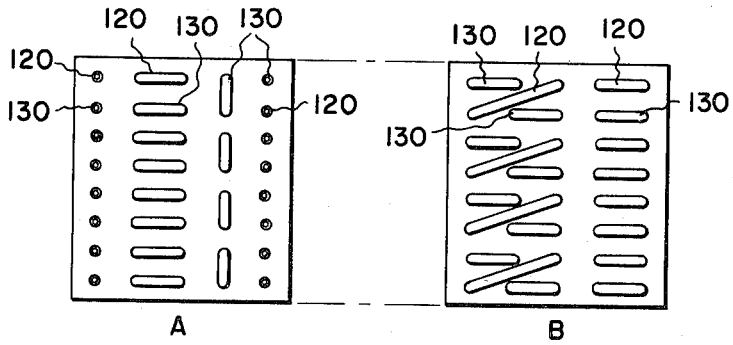
FIG. 12
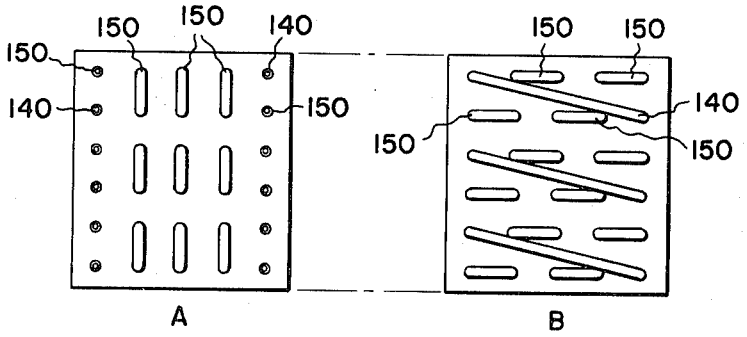
FIG. 13

HEAT EXCHANGER TUBE CIRCUITS

DESCRIPTION

1. Technical Field

This invention pertains generally to the field of heat exchangers, and specifically to the field of tube circuits for heat exchangers coils which provide same-end inlet and outlet connections.

2. Background Art

Fin and tube coils are used in many different applications for transferring heat between fluids. Air conditioning systems often use cold water or refrigerant to cool air, and use steam or hot water to warm the air supplied to a conditioned space. Fin and tube coils are popular for use in such systems in that the coils are relatively compact when compared with apparatus for other heat transfer methods, and the coils can be installed in an air flow duct relatively easily. Further, fin and tube coils are readily adaptable to different types of systems, including chilled water or brine and direct expansion cooling applications, as well as steam or hot water heating applications. Parallel and counterflow relationships between the fluid in the coil and the airflow can be used, though counterflow arrangements are most popular in that, for given conditions, less surface area for heat transfer is required for counterflow than parallel flow coils.

In designing chilled water or brine air cooling systems and hot water air heating systems an air conditioning engineer has available a wide range of coil constructions to meet his needs and preferences. For example, copper or aluminum can be used as fin material, the number of tube circuits can be varied, and the number of rows or passes for the tubes in each circuit can be varied. The coils can be "half-circuited," in which every other tube in a column is fed on the supply side; "full-circuited," in which every tube of a column is fed; or "double-circuited," in which every tube of two columns is fed. Coils can be provided with "opposite end connections," in which supply and return lines are connected to opposite sides of the coil, or the coil can have "same-end connections," in which the supply and return lines are connected on the same end of the coil.

While the selections among the available options may be, in some instances, primarily a choice influenced by the personal preferences of the engineer designing the system, the performance and flow requirements, and the physical arrangement of the components and piping are also factors which affect the selection. Full-circuit, same-end connection coils have achieved wide-spread popularity, primarily because such coils can be installed easily, with the supply line and the return line being connected to the same end of the coil, and the flow and capacities of the full-circuit coils are generally quite satisfactory. Unfortunately, however, not all coil capacities are available in full-circuit, same-end connection designs, such as, for example, three-row full-circuited coils. Full-circuited, three-row coils have been available only in opposite end connection, and three-row, same-end connection coils have been available only in half-circuit designs. Thus, a capacity gap has existed between two-row and four-row, same-end connection, full-circuit coils. When a system requires a coil having the capacity of a three-row coil, and the desired arrangement is full-circuiting and same-end connection, the system designer has been forced to use a four-row coil, which has greater than necessary capacity. By decreasing flow and substantially reducing the fin counts on the four-row fin and tube coil, the heat transfer capacity of the coil can be properly sized for the system; however, the four-row coil substantially increases the initial cost of the system, even when the low fin counts are used.

The capacity gaps in other same-end connection coil series are not as great as that at the three-row, same-end connection size; however, other capacity gaps do exist. For example, six-row, double-circuit coils have been of opposite end connection design in the past, and in some circumstances, it is desirable to use a six-row, double-circuited coil with same-end connections. Other capacity gaps in same-end connection coil series can be achieved more readily by variations in the fin counts of over-sized coils.

SUMMARY OF THE INVENTION

It is therefore one of the principal objects of the present invention to provide circuiting arrangements for tubes in fin and tube heat exchangers for coil designs not previously available, including three-row, same-end connection, full-circuit coils, and six-row, same-end connection, double-circuit coils.

Another object of the present invention is to provide tube circuits for fin and tube coils which have first and second conduits of different lengths but substantially equal pressure drop and flow in each conduit.

Yet another object of the present invention is to provide tube circuits for fin and tube coils which can be manufactured easily and economically to provide tube circuits of designs not previously available at competitive costs.

Still another object of the present invention is to provide, in the preferred embodiments, circuits which are drainable by gravity.

These and other objects are achieved in the present invention by providing coil circuits which each have conduits of first and second types. In a preferred embodiment, the first type conduit is generally U-shaped, having two tubes and an interconnecting end section, with an inlet and an outlet for the conduit disposed one in each tube on the same end of the coil. The second type conduit of the preferred embodiment has four tubes with interconnecting end sections disposed therebetween. Inlet and outlet openings are provided in the first and fourth tubes and are disposed adjacent the inlet and outlet of the first conduit on the same end of the assembled coil. In a three-row, same-end connection, full-circuited coil the first type conduit has tubes in the first and third rows, and the second type conduit has one tube in the first row, either above or below the first tube of the first conduit, two tubes in the second row, and one tube in the third row, either above or below the second tube of the first conduit. Thus, in the three-row, full circuited coil the inlets of the conduits are vertically adjacent in the first row and the outlets are vertically adjacent in the third row. In a six-row, same-end connection, double-circuited coil, the tubes of each circuit lie in a single plane, with the inlets of each in horizontally adjacent rows, and with the outlets of each in horizontally adjacent rows. A turbulence promoting device may be disposed in the first type conduit to equalize the pressure drop and flow in the first conduit to that in the second type conduit.

BRIEF DESCRIPTION OF THE DRAWINGS

FIG. 11 is a perspective view of a six-row, same-end connection, double-circuited coil embodying the present invention.

FIGS. 12 and 13 are elevational views of the ends of two embodiments for five-row, same-end connection, full-circuited coils encompassing the present invention, with the front end of each coil in each Figure being generally designated by the letter A, and the back end of each coil in each Figure being generally designated by the letter B.

DETAILED DESCRIPTION OF THE PREFERRED EMBODIMENT

Figure 1A:
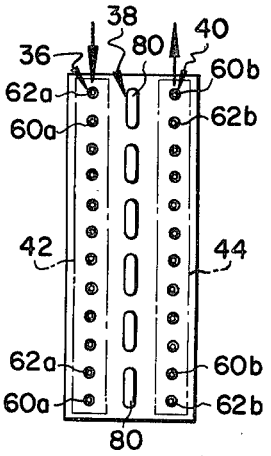
FIGS. 1A and 1B are front and back elevational views, respectively, of the coil shown in FIG. 1.
Figure 1:
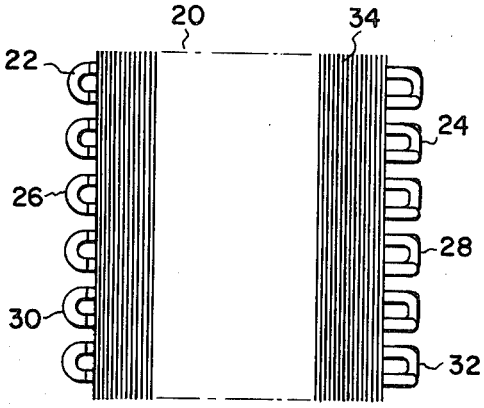
FIG. 1 is a side elevational view of a three-row, same-end connection, full-circuited coil embodying the present invention.
Figure 1B:
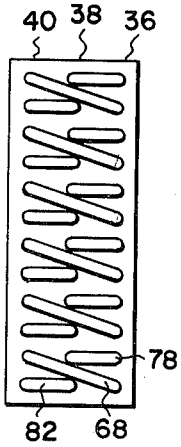

Referring now more specifically to the drawings, and to FIGS. 1, 1A and 1B in particular, numeral 20 designates a three-row, same-end connection, full-circuited fin and tube heat exchanger coil embodying the present invention, having tube circuits 22, 24, 26, 28, 30, and 32, and fins designated generally with numeral 34. Coil 20 can be used to transfer heat between a first fluid flowing through the tube circuits and a second fluid, typically, air, passing along the fins and over the tube circuits. Thus, the coil can be used to heat or cool air, and the fluid in the tube circuits can be water, brine, glycol, or the like. The fins may be of copper, aluminum or the like, affixed in suitable well-known techniques to the tubes. Materials for the tubes and fins and the manner of connecting the fins to the tubes are well-known to those familiar with the art of heating and/or cooling coils and will not be described further herein.

The coil 20 consists of three vertical rows of tubes designated generally by the numerals 36, 38, and 40 in the drawings. As designated by the arrows in FIG. 1A, each tube circuit has openings in row 36 which are inlet openings for the circuits, and has openings in row 40 which are the outlet openings for the circuits, and each circuit includes two vertically aligned tubes in each row. Typically, an inlet header and an outlet header are provided for the inlet and outlet openings, respectively, and supply and return lines for the fluid flowing through the circuits are connected to the headers. The locations for the inlet and outlet headers have been indicated in FIG. 1A by the dashed lines designated with numerals 42 and 44, respectively.

Figure 2:
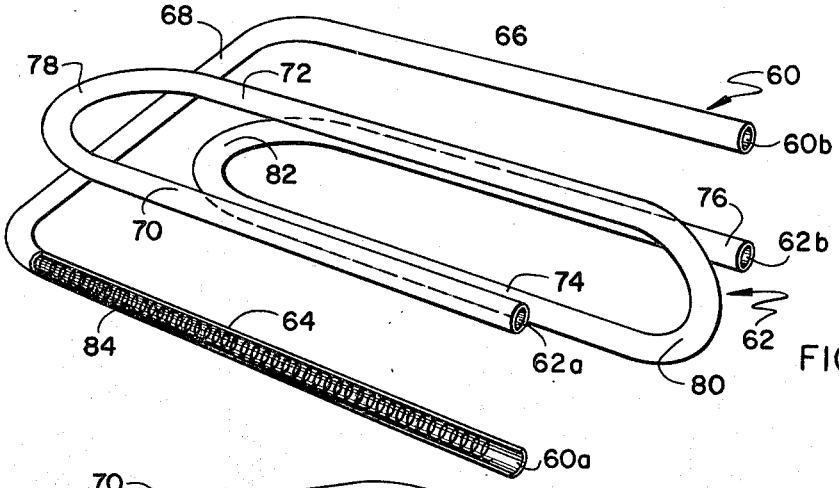
FIG. 2 is an enlarged perspective view, partially broken away, of one of the tube circuits of the coil.

With reference now particularly to FIG. 2, a single tube circuit similar to circuits 22, 24, 26, 28, 30 and 32 will be described. Each of the circuits in coil 20 is similar to that shown in FIG. 2, and any number of circuits may be provided in a coil. The six circuits shown in FIG. 1 are merely demonstrative of a typical three-row coil. The tube circuits include a first conduit 60 and a second conduit 62 having inlets 60*a* and 62*a* and outlets 60*b* and 62*b*, respectively. Each circuit then includes two vertically adjacent inlets and two vertically adjacent outlets, one inlet and one outlet for each conduit in the circuit. The first type conduit 60 includes a first tube or leg 64 and a second tube or leg 66, the first tube being disposed in the first row and the second tube being disposed in the third row. An interconnecting end section 68 is disposed between the first and second tubes of the first type conduit. In the embodiment shown in FIGS. 1, 1A, 1B, and 2 end section 68 angles upwardly from the first tube to the second tube of the first type conduit. Thus, tube 64 is the lower of the two tubes in the first row of the circuit, and tube 66 is the upper of the two tubes disposed in the third row of the tube circuit.

Figure 3:
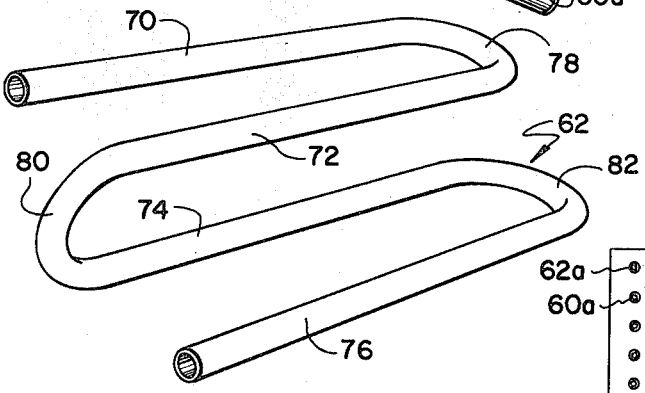
FIG. 3 is a perspective view of one of the conduits of the tube circuit shown in FIG. 2.

The second type conduit 62 includes four tubes or legs, a first tube 70 disposed in the first row, a second tube 72 being the upper tube of the middle row of the circuit, a third tube 74 being the lower tube of the middle row of the circuit and a fourth tube 76 being the lower tube of the third row of the circuit. A substantially horizontal interconnecting end section 78 is disposed between the first and second tubes, a substantially vertical interconnecting end section 80 is disposed between the second and third tubes, and a substantially horizontal interconnecting end section 82 is disposed between the third and fourth tubes of the second type conduit. The second type conduit is shown individually in FIG. 3, where it can be seen that the first and second tubes are disposed in a first substantially horizontal plane, and the third and fourth tubes are disposed in a second substantially horizontal plane different from that of the first and second tubes. The second and third tubes are disposed in a common vertical plane, which essentially comprises the plane of the middle row of the three-row coil.

In the use of a tube circuit as described hereinabove, the first and second conduits are positioned such that the inlets and outlets are in vertical proximity as described above, fins are attached by conventional well-known techniques and the headers and other heat exchanger structural components are assembled. Supply and return fluid lines are connected to the headers when the heat exchanger is properly positioned in a duct or other conduit for the fluid being temperature conditioned. The coil-carried fluid is fed to inlets 60*a* and 62*a*, respectively, of the first and second conduits in each tube circuit, and the fluid flows through the conduits to the outlets 60*b* and 62*b*. The fluid being conditioned, usually air, flows over the tube and between the fins in conventional fashion, and in this regard coils using tube circuits of the present invention operate similarly to previously known coil designs. The present invention, however, now makes available coil capacities and designs with same-end inlet and outlet connections which were not previously available. An advantage of the present invention is that although previously unavailable same-end connection coils are now structurally possible through use of the invention, the new coils do not vary significantly from other coils in the same or similar coil series, relative to final installation and use, and the new coils can be used equally as well as other coils in the series.

Since the second type conduit is substantially longer than the first type conduit, having four tubes as compared with the two tubes of the first type conduit, it is desirable to equalize the pressure drop and flow in the conduits. Thus, a means for decreasing flow and increasing pressure drop in the first conduit is used. A particularly advantageous means is shown in the drawings wherein a turbulence promoting device 84 is disposed in the first type conduit to decrease flow and increase pressure drop in the first type conduit. The device may comprise a coiled wire of bronze or the like, and in addition to equalizing the flow and pressure drop in the first conduit to that in the second, the device has the added beneficial effect of increasing the tube side heat transfer coefficient, thereby enhancing the heat transfer between the fluid in the tube and the air passing thereover. Other types of turbulence promoting devices may be used to decrease flow, or various flow restrictors such as an orifice may also be used.

Figure 4:
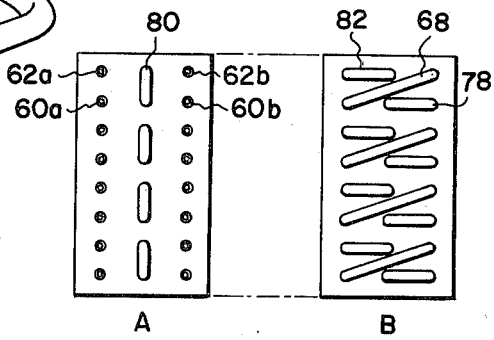
FIGS. 4–10 are elevational views of the ends of three-row, same-end connection, full-circuited coils having alternative tube circuit configurations embodying the present invention, with the front end of each coil in each Figure being generally designated by the letter A, and the back end of each coil in each Figure being generally designated by the letter B.
Figure 5:
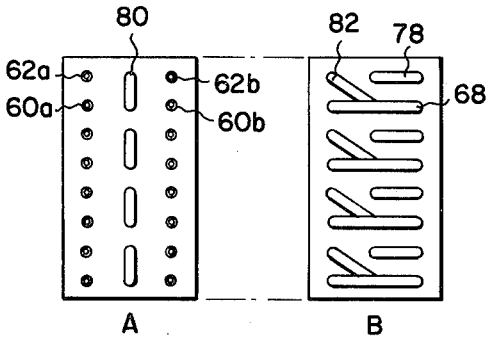
Figure 6:
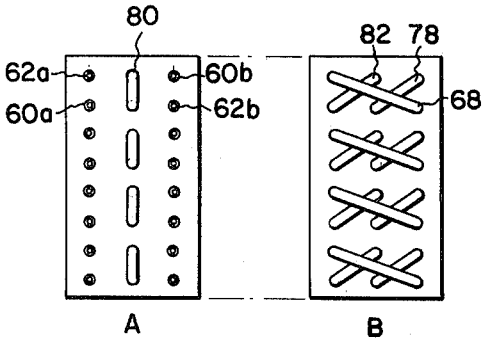
Figure 7:
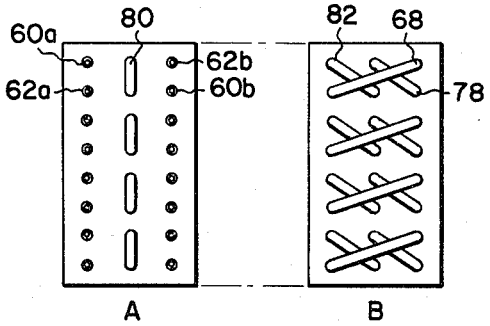
Figure 8:
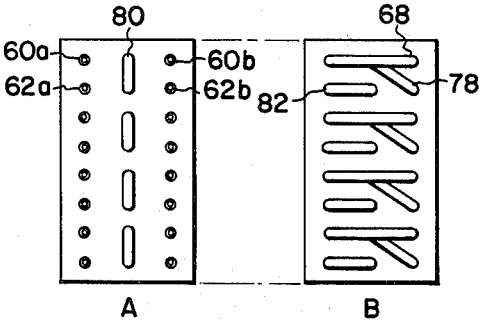
Figure 9:
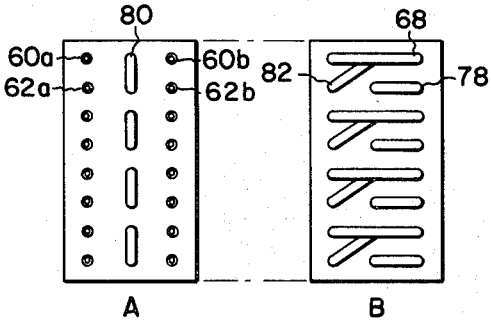
Figure 10:
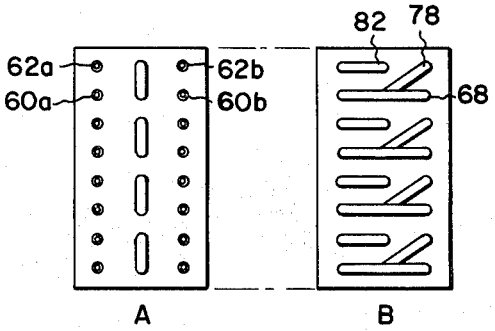

It should be understood that other arrangements for the tubes of each type conduit can be used to achieve the three-row, same-end connection, full-circuit arrangement. For example, in the coil shown in FIG. 4 the first tubes of the first type conduits are disposed in the top positions in each circuit, the second tubes of the first type conduit are disposed in the bottom positions in the third row of each circuit, and the inerconnecting end section 68 angles downwardly from the first tube to the second tube. This arrangement works equally as well as that described previously, and is equally desirable from a manufacturing viewpoint. FIGS. 5, 6, 7, 8, 9, and 10 show other arrangements for the tubes of the conduits in a three-row, same-end connection, full-circuit coil. In each of the drawings, a single tube circuit has been designated with numerals corresponding to those previously used in describing the preferred circuits, wherein the inlet and outlet of the first type conduit are numbered 60*a* and 60*b*, respectively, and the inlet and outlet of the second type conduit are numbered 62*a* and 62*b*, respectively. The end section between the first and second tubes of the first type conduit is designated with numeral 68. The connecting end section between the first and second tubes of the second type conduit is designated with the numeral 78, the connecting section between the second and third tubes of the second type conduit is designated with numeral 80, and the connecting section between the third and fourth tubes of the second type conduit is designated with numeral 82. All of the configurations shown can be used for three-row, same-end connection, full-circuited coils; however, it is felt that either the configuration shown in FIG. 2 or that shown in FIG. 4 is preferable in that, from a manufacturing viewpoint, the bends and crossings of the connecting end sections required in the embodiments shown in FIGS. 5–10 would be more costly and therefore less desirable. Further, it is preferred that the tubes of the coil drain by gravity into one or the other of the headers attached thereto. The preferred embodiments shown in FIGS. 1 through 4 will drain by gravity, as will those shown in FIGS. 6 and 7 when the coil is installed substantially level.

With reference now to FIG. 11, an embodiment of the invention for a six-row, double-circuited fin and tube coil circuit having same-end connections will be described. In double-circuited coils each tube in two vertical rows is fed with fluid. In FIG. 11, the tube circuit consists of a first type conduit and a second type conduit 90 and 92, respectively, with inlets 90*a* and 92*a* and outlets 90*b* and 92*b*. The first type conduit includes first and second tubes 94 and 96, with an interconnecting end section 98. In the embodiment shown, the first and second tubes of the first type conduit comprise the first and sixth rows in the six-row coils. The second type conduit includes four tubes 100, 102, 104, and 106 disposed in, respectively, the second, third, fourth, and fifth rows of the circuit. Interconnecting sections 108, 110, and 112 are disposed between the first and second, between the second and third, and between the third and fourth tubes, respectively. All of the tubes of the first and second type conduits in each circuit of the six-row coil are disposed in the same substantially horizontal plane, with the inlets for the conduits of each circuit being horizontally adjacent, and the outlets for the conduits in each circuit being horizontally adjacent. A turbulence promoting device 114 may be disposed in the first type conduit to equalize flow and pressure drop between the conduits. A plurality of six-row tube circuits can be used in a single coil, with an inlet header provided for the inlets 90*a* and 92*a* and an outlet header provided for the outlets 90*b* and 92*b*.

Further modifications of the three-row, full-circuited and six-row, double-circuited coils can also be used. For example, in the three-row coil the inlet and outlet tubes can be disposed in the first and second rows or in the second and third rows, rather than in the first and third rows as shown. Similarly, the tubes of the six-row coil can be alternatively arranged, thereby locating the circit inlets and outlets in other rows. These and other configurations still fall within the broad scope of providing coil circuits including first and second conduits, with one of the conduits having a greater number of passes through the coil than has the other conduit.

The concept of using two conduits of different lengths in each coil circuit can be applied to other sizes and series of coils to provide same-end connection coils. For example, a five-row, full-circuited coil with same-end connections is shown in FIG. 12, and a modification thereof is shown in FIG. 13. In FIG. 12 each circuit contains two conduits with vertically adjacent inlets and vertically adjacent outlets. One conduit is a four-tube conduit and the other is a six-tube conduit, with appropriate interconnecting end tube sections. The visible portions of the four-tube conduit have been designated with numeral 120 and the visible portions of the six-tube conduit have been designated with numeral 130 in one circuit of FIG. 12. In the embodiment shown in FIG. 13 each circuit also contains two conduits, with vertically adjacent inlets and vertically adjacent outlets. In this embodiment, however, one conduit has two tubes and the other conduit has eight tubes, with appropriate interconnecting end sections. Portions of the two-tube conduit have been designated with numeral 140, and portions of the eight-tube conduit have been designated with numeral 150 for one circuit of the coil shown in FIG. 13. It should be understood that other configurations for a five-row coil can be used, with the shorter of the conduits in each circuit having either two or four tubes and the longer of the conduits in each circuit having eight or six tubes, respectively. When necessary, flow restrictions or turbulence promoting devices can be used to equalize the flow and pressure drop in the conduits.

Although numerous embodiments for three-row, and five-row same-end connection, fully-circuited coils and an embodiment of a six-row, same-end connection double-circuited coil have been shown and described in detail herein, various other changes may be made without departing from the scope of the present invention.

We claim:

1. A multi-row heat exchanger coil having a plurality of substantially horizontal, vertically separated, circuits, each circuit comprising first and second multi-row substantially horizontal conduits, each conduit having a plurality of tubes extending the length of the heat exchanger and having interconnecting end sections disposed between the tubes for providing a continuous path of flow communication between the tubes in each conduit; said first conduit having fewer tubes than said second conduit, and having an even number of tubes at least as great as two; said second conduit having an even number of tubes at least as great as four; one tube of each of said first and second conduits forming inlet tubes for fluid to flow into said first and second conduits, and another of the tubes of each of said first and second conduits forming outlet tubes for fluid to flow from said first and second conduits; said inlet tube of the first conduit being disposed adjacent said inlet tube of the second conduit in the assembled coil, and said outlet tube of the first conduit being disposed adjacent said outlet tube of the second conduit in the assembled coil; at least one row of said heat exchanger coil being entirely comprised of inlet tubes, and another row of said heat exchanger coil being entirely comprised of outlet tubes.

2. A multi-row heat exchanger coil as defined in claim 1 in which a means is provided for equalizing the flow and pressure drop in the conduits.

3. A multi-row heat exchanger coil as defined in claim 2 in which said means includes a turbulence promoting device disposed in said first conduit.

4. A tube circuit for a multi-row heat exchanger coil, said tube circuit being substantially horizontal and comprising substantially horizontal conduits of a first and a second type, each conduit forming a generally elongated path for the flow of a fluid; inlet and outlet openings for each of said conduits disposed on the same end of the coil; said first type conduit having inlet and outlet substantially horizontal tubes and an interconnecting end section therebetween forming a generally U-shaped path for the flow of a fluid therein; said second type conduit having an even number of substantially horizontal tubes at least as great as four (4) and having interconnecting end sections between the tubes, the first and last tubes of said second type conduit forming an inlet tube and an outlet tube respectively for fluid flow through said second type conduit; said first tubes of said conduits being disposed adjacent each other in the assembled circuit, and said second tube of said first conduit being disposed adjacent the last tube of said second conduit in the assembled coil; at least one row of said heat exchanger coil being entirely comprised of inlet tubes, and another row of said heat exchanger coil being entirely comprised of outlet tubes.

5. A tube circuit for a heat exchanger coil as defind in claim 4 in which said inlet and outlet tubes of said first type conduit are disposed in different horizontal planes.

6. A tube circuit for a heat exchanger coil as defined in claim 4 or 5 in which said second type of conduit includes four tubes disposed in two horizontal planes and three vertical planes, the central of said three vertical planes containing tubes in each of said two horizontal planes.

7. A tube circuit for a heat exchanger coil as defined in claim 6 in which said tubes of said second type conduit disposed in the outer vertical planes are disposed in different horizontal planes.

8. A tube circuit for a heat exchanger coil as defined in claim 6 in which a turbulence promoting device is disposed in said first type conduit.

9. A tube circuit for a heat exchanger coil as defined in claim 8 in which said tubes of said second type conduit disposed in the outer vertical planes are disposed in different horizontal planes.

10. A tube circuit for a heat exchanger coil as defined in claim 4 or 5 in which a means is provided for equalizing the flow and pressure drop in the conduits.

11. A tube circuit for a heat exchanger coil as defined in claim 4 in which said tubes of said first type conduit are disposed in a common horizontal plane.

12. A tube circuit for a heat exchanger coil as defined in claim 11 in which said tubes of said second type conduit are disposed in the same horizontal plane as said tubes of said first type conduit.

13. A tube circuit for a heat exchanger coil as defined in claim 11 or 12 in which a turbulence promoting device is disposed in said first type conduit.

14. A tube circuit as defined in claim 4 in which said interconnecting end section of said first type conduit is substantially horizontal; said second type conduit has first, second, third, and fourth tubes in horizontal alignment with said tubes of said first type conduit and has interconnecting end sections disposed between the tubes, said first and fourth tubes being the inlet tube and the outlet tube respectively of said second type conduit; said inlet tubes of said conduits are disposed in horizontally adjacent rows of said coil; and said outlet tube of said first type conduit and said outlet tube of said second type conduit are disposed in horizontally adjacent rows of said coil.

15. A tube circuit as defined in claim 14 in which a means is provided for equalizing the flow and pressure drop of a fluid circulated through said conduits.

16. A tube circuit as defined in claim 15 in which said means includes a turbulence promoting device disposed in said first tube of said first type conduit.

17. A tube circuit for a three-row, full-circuited heat exchange coil comprising conduits of a first and a second type; said first type conduit being of a generally U-shaped configuration having first and second tubes disposed in the first and third rows of the coil respectively, and an interconnecting end section therebetween, said first tube being the inlet and said second tube being the outlet of said first conduit; said second type conduit having first, second, third and fourth tubes, with interconnecting end sections disposed between the tubes; said first tube of said second conduit being the inlet of said second type conduit and being in vertical alignment with said first tube of said first type conduit in the first row of said coil; said second and third tubes of said second type conduit being in vertical alignment with each other in said second row of said coil; and said fourth tube being the outlet of said second type conduit and being disposed in vertical alignment with said second tube of said first type conduit in said third row of said coil.

18. A tube circuit for a three-row full-circuited heat exchange coil as defined in claim 17 in which said first-mentioned interconnecting end section is disposed angularly between said tubes of said first conduit.

19. A tube circuit for a three-row full-circuited heat exchange coil as defined in claim 17 or 18 in which a means is provided for equalizing the flow and pressure drop of a fluid circulated through said conduits.

20. A tube circuit for a three-row full-circuited heat exchange coil as defined in claim 19 in which said means includes a turbulence promoting device disposed in said first tube of said first type conduit.

* * * * *